US006467407B2

(12) United States Patent
Nogi et al.

(10) Patent No.: US 6,467,407 B2
(45) Date of Patent: Oct. 22, 2002

(54) STENCIL PRINTING MACHINE

(75) Inventors: Hideaki Nogi; Katsuro Motoe, both of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/769,731

(22) Filed: Jan. 26, 2001

(65) Prior Publication Data

US 2001/0013287 A1 Aug. 16, 2001

(30) Foreign Application Priority Data

Jan. 31, 2000 (JP) ..... 2000-022343

(51) Int. Cl.[7] ..... B41L 13/06
(52) U.S. Cl. ..... 101/120; 101/116
(58) Field of Search ..... 101/114, 116, 101/119, 120, 123, 124, 127, 127.1

(56) References Cited

U.S. PATENT DOCUMENTS 5,617,786 A * 4/1997 Negishi ..... 101/116
5,673,620 A * 10/1997 Negishi et al. ..... 101/116
5,913,265 A * 6/1999 Ishii et al. ..... 101/116
6,173,646 B1 * 1/2001 Tanaka et al. ..... 101/116
6,247,401 B1 * 6/2001 Sato et al. ..... 101/116
6,311,614 B1 * 11/2001 Ogata et al. ..... 101/116

FOREIGN PATENT DOCUMENTS

EP 0 963 856 12/1999

* cited by examiner

*Primary Examiner*—Ren Yan
(74) *Attorney, Agent, or Firm*—Kanesaka & Takeuchi

(57) ABSTRACT

A stencil printing machine includes a squeegee roller in a printing drum having a peripheral wall having an ink-nonpermeable nonperforated portion around an ink-permeable perforated portion to have a stencil sheet and a printing the print sheet therearound. A projected portion is provided on the nonperforated portion. The thickness of the nonperforated portion is formed thicker than that of the perforated portion, and accordingly, press force exerted to the peripheral wall and the stencil sheet by the squeegee roller and the outer roller is enhanced on the nonperforated portion. Therefore, spread of ink is stopped within the perforated portion and ink is prevented from leaking from a gap between the outer peripheral face of the nonperforated portion of the peripheral wall and the stencil sheet.

8 Claims, 11 Drawing Sheets

STENCIL PRINTING MACHINE

BACKGROUND OF THE INVENTION AND RELATED ART STATEMENT

The present invention relates to a stencil printing machine for sandwiching a print sheet between a printing drum wound with a stencil sheet and a roller to thereby transfer the print sheet and printing the print sheet by supplying ink from an inner portion of the printing drum. Particularly, the present invention relates to a stencil printing machine preventing ink from being leaked from between the printing drum and the stencil sheet in the stencil printing machine.

An explanation will be given of an example of a structure of a conventional stencil printing machine and a problem thereof in reference to FIG. 11 through FIG. 13. As shown by FIG. 11, the stencil printing machine is provided with a printing drum 100 in a shape of a hollow cylinder and an outer roller 101 provided outside of the printing drum 100. The printing drum 100 and the outer roller 101 are arranged by interposing a predetermined interval therebetween and central axes thereof are in parallel with each other.

First, the printing drum 100 is provided with two pieces of side plates arranged to be opposed to each other by interposing a predetermined interval therebetween and one piece of a shaft 103 for coaxially connecting the two side plates 102. The side plates 102 and the shaft 103 are rotatably provided in a frame of the printing machine. The side plates 102 and the shaft 103 are driven to rotate by being connected to driving means, not illustrated.

Outer peripheral faces of the side plates 102 are wound with a flexible peripheral wall 104. One end of the peripheral wall 104 is fixed and placed on the respective side plates 102. The other end thereof is connected by a spring. The peripheral wall 104 is formed with an ink-permeable perforated portion 105 substantially in a rectangular shape. The perforated portion 105 corresponds to a printing area. Further, a surrounding of the perforated portion 105 constitutes a nonperforated portion 109 for preventing ink from permeating therethrough. Although not illustrated, ink supplying means is provided at the inner portion of the printing drum 100. The ink supplying means can supply ink to an inner peripheral face of the printing drum 100. An inner roller 106 is provided at the inner portion of the printing drum 100. The inner roller 106 is attached pivotably to the shaft 103. The inner roller 106 is moved to lift and lower at predetermined timings in synchronism with rotation of the printing drum 100 and presses the peripheral wall 104 to an outer side in printing operation. The peripheral wall 104 pressed by the inner roller 106 is deformed to an outer side against urge force of the spring, mentioned above.

As shown by FIG. 12, a perforated stencil sheet 107 is wound around the outer peripheral face of the peripheral wall 104 of the printing drum 100. The stencil sheet 107 covers all of the perforated portion 105 of the peripheral wall 104. The stencil sheet 107 is of a size covering the nonperforated portion 109 at the surrounding of the perforated portion 105. When the printing drum 100 is rotated, the inner roller 106 is lifted and lowered in synchronism therewith. A print sheet 108 is supplied between the printing drum 100 and the outer roller 101 at a predetermined timing. The print sheet 108 is transferred while being sandwiched between the peripheral wall 104 deformed outwardly by being pressed by the inner roller 106 and the outer roller 101. During the time period, ink is transcribed onto the print sheet 108 by permeating from the perforated portion 105 through a perforated portion of the stencil sheet 107 to thereby carry out stencil printing.

However, the stencil sheet 107 is only wound around the outer peripheral face of the peripheral wall 104 and brought into contact therewith. Therefore, when the stencil sheet 107 is applied with pressure by being sandwiched between the inner roller 106 and the outer roller 101, as shown by FIG. 13, ink which has permeated through the perforated portion 105 of the peripheral wall 104 spreads to outer sides. Thereby, there has been a case in which ink leaked out from a gap between the nonperforated portion 109 of the peripheral wall 104 and the stencil sheet 107.

SUMMARY OF THE INVENTION

Hence, it is an object of the present invention to provide a stencil printing machine capable of preventing ink from leaking out from between a peripheral wall and a stencil sheet in order to resolve the above-described problem.

In order to achieve the above-described object, according to a first aspect of the present invention, there is provided a stencil printing machine comprising:

a printing drum 1 in a cylindrical shape having a peripheral wall 7 having an ink-nonpermeable nonperforated portion 123 around an ink-permeable perforated portion 121, wound with a perforated stencil sheet 127 on an outer peripheral face of the peripheral wall 7 and rotating around a central axis line of the printing drum 1 per se;

ink supplying means provided at inside of the printing drum 1 for supplying ink onto an inner peripheral face of the peripheral wall 7;

an inner roller 23 provided at the inside of the printing drum 1 in parallel with the printing drum 1 and brought into contact with the inner peripheral face of the peripheral wall 7 over the perforated portion 121 and the nonperforated portion 123; and an outer roller 63 provided at outside of the printing drum 1 in parallel with the printing drum 1 and brought into contact with the outer peripheral face of the peripheral wall 7;

wherein a thickness t2 of the nonperforated portion 123 is formed to be thicker than a thickness t1 of the perforated portion 121 and the nonperforated portion 123 is projected to the inner peripheral face of the peripheral wall 7; and wherein the nonperforated portion 123 is sandwiched between the inner roller 23 and the outer roller 63.

According to a second aspect of the present invention, there is provided the stencil printing machine in the stencil printing machine according to the first aspect:

wherein a portion of the nonperforated portion 123 formed to be thicker than the perforated portion 121 is constituted by a projected portion 125 provided on the nonperforated portion 123 on the side of the inner peripheral face of the peripheral wall 7; and wherein the projected portion 125 is formed along both side edge portions of the perforated portion 121 in a direction of rotating the printing drum 1.

According to a third aspect of the present invention, there is provided the stencil printing machine in the stencil printing machine according to the first aspect:

wherein a portion of the nonperforated portion 123 formed to be thicker than the perforated portion 121 is constituted by a projected portion 125 provided on the nonperforated portion 123 on the side of the inner peripheral face of the peripheral wall 7; and wherein the projected portion 125 is formed along both side edge portions and a rear side edge portion of the perforated portion 121 in a direction of rotating the printing drum 1.

According to a fourth aspect of the present invention, there is provided the stencil printing machine in the stencil printing machine according to the second aspect or the third aspect:

wherein the inner roller 23 is formed with recess portions 129 brought in mesh with the projected portions 125 and constituting recesses lower than a height of the projected portions 125 at portions of the inner roller 23 brought into contact with the projected portions 125 formed along the both side edge portions of the perforated portion 121.

According to a fifth aspect of the present invention, there is provided the stencil printing machine in the stencil printing machine according to the first aspect:

wherein the nonperforated portion 123 is constituted by coating an ink-nonpermeable material to a surrounding of the perforated portion 121 constituted by weaving flexible wire members in a shape of a net to constitute the perforated portion 121.

In printing operation, the inner roller 23 is lowered and is brought into contact with the inner peripheral face of the peripheral wall 7. The peripheral wall 7, the stencil sheet 127 and the print sheet P are sandwiched between the inner roller 23 and the outer roller 63. At this occasion, the nonperforated portion is thicker than the perforated portion 121 and accordingly, press force exerted to the peripheral wall 7 becomes higher at the nonperforated portion 123 than at the perforated portion 121. Ink which has permeated through the stencil sheet 127 is not moved to the side of the nonperforated portion 123 having larger pressure and is stopped on the side of the perforated portion 121 having smaller pressure.

DETAILED DESCRIPTION OF THE PREFERRED EMBODIMENTS

Figure 1:
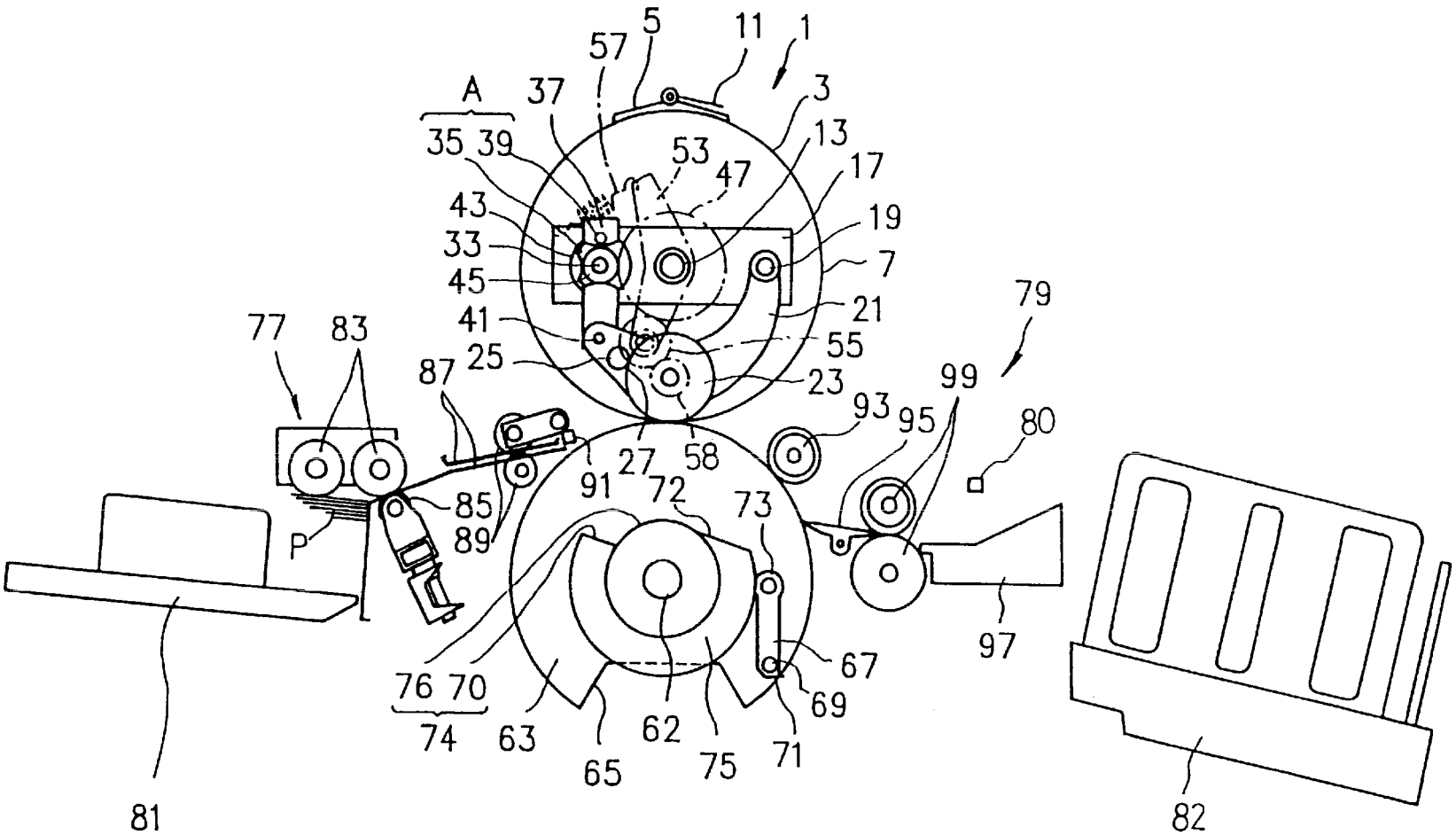
FIG. 1 is a schematic side view showing an example of a structure of a stencil printing machine to which the present invention is applicable and is a view showing a printing state.

A specific explanation will be given of embodiments of the present invention in reference to the drawings as follows.

FIG. 1 through FIG. 4 are showing the stencil printing machine of the embodiments of the present invention. A printing drum 1 is provided with two side plates 3 in a shape of a circular plate arranged at both ends thereof, a rigid clamp base plate 5 in parallel with the axis line direction for connecting the two side plates 3 and a peripheral wall 7 constituting an essential portion of the present invention.

Although an explanation will be given as follows of a specific structure of the peripheral wall 7, as the basic structure, flexible wire members comprising stainless steel wires are woven in a shape of a net. Therefore, the peripheral wall 7 is provided with flexibility and print ink can permeate therethrough. Further, the peripheral wall 7 is wound around outer peripheral faces of the side plates 3. One end of the wound peripheral wall 7 is fixed to the clamp base plate 5. The other end thereof is connected to the clamp base plate 5 via a spring. In this way, the peripheral wall 7 is arranged in a cylindrical shape along the outer peripheral faces of the respective side plates 3.

The clamp base plate 5 is pivotably attached with a clamp plate 11. The clamp plate 11 can clamp one end (front end) of a stencil sheet. A stencil sheet is wound around the outer peripheral face of the peripheral wall 7 after a front end thereof is locked by the clamp base plate 5 by the clamp plate 11.

The printing drum 1 is supported rotatably around a central axis line of its own by a central cylindrical shaft 13. The outer peripheral portions of the side plates 3 are respectively formed with gear portions 15 for driving the printing drum. Further, the printing drum driving gear portions 15 are brought in mesh with drive gears of the printing drum gear motor, not illustrated.

At inside of the printing drum 1, an in-drum frame 17 supported by the central cylindrical shaft 13 is fixedly arranged. The in-drum frame 17 supports one end of a roller support arm 21 by an axial shaft 19 pivotably substantially in the up and down directions. The roller support arm 21 rotatably supports a squeegee roller 23 as an inner roller at a middle portion thereof. The squeegee roller 23 is extended in parallel with the central axis line of the printing drum 1 and an outer peripheral face thereof is brought into sliding contact with an inner peripheral face of the peripheral wall 7. Further, the squeegee roller 23 is constituted by an elastic material of rubber or the like.

The roller support arm 21 fixedly supports a doctor rod 25 extended in parallel with an outer peripheral face of the squeeze roller 23 with a very small interval therebetween. An ink store portion 27 in a shape of a wedge is formed between the squeegee roller 23 and the doctor rod 25. An ink delivery pipe 29 for measuring and supplying ink to the ink store portion 27, is extended in parallel with central axis lines of the squeegee roller 23 and the doctor rod 25 at inside of the printing drum 1. The ink delivery pipe 29 is connected with an ink supply hose 31. The ink supply hose 31 is extended to outside of the printing drum 1 by passing through the central cylindrical shaft 13 and connected to an ink supply source, not illustrated, installed at outside of the printing drum 1. These constitutions constitute ink supplying means.

The in-drum frame 17 rotatably supports a cam shaft 33. The in-drum frame 17 is provided with a cam mechanism A constituted by an outer shape plate cam 35 and a cam follower 39. The outer shape plate cam 35 is fixed to the cam shaft 33. The cam follower 39 is attached to an engaging yoke member 37. According to the cam mechanism A, there can be provided selectively two stable states of a print executing rotational position and a print nonexecuting rotational position by divisional rotation of the outer shape plate cam 35 by respective 90 degree. Further, the engaging yoke member 37 is connected to the other end of the roller support arm 21 by an axial shaft 41.

The cam shaft 33 is connected to a follow side of an electromagnetic clutch 43. A drive side of the electromagnetic clutch 43 is connected to a cam shaft drive gear 45. Thereby, the cam shaft drive gear 45 and the cam shaft 43 are connected to selectively drive. The cam shaft drive gear 45 is brought in mesh with an in-drum main gear 47 fixed to the side plate 3 of the printing drum 1 and is driven to rotate in accordance with rotation of the printing drum 1.

The in-drum frame 17 is attached with a cam switch 49 constituted by a limit switch. The cam switch 49 is engaged with a switch operating piece 51 attached to the engaging yoke member 37 for confirming upper and lower operations of the squeegee roller 23.

The central cylindrical axis 13 pivotably supports a middle portion of a roller drive arm 53 at inside of the printing drum 1. One end of the roller drive arm 53 rotatably supports an intermediary gear 55. The other end thereof is connected to a tensile spring 57 and is urged in the counterclockwise direction in FIG. 1 by spring force of the tensile spring 57. By the urging operation, the intermediary gear 55 is brought in mesh with the in-drum main gear 47 and a gear 58 provided at an end portion of the squeegee roller 23 concentrically therewith. Further, the intermediary gear 55 is rotated in accordance with rotation of the printing drum 1 and drives to rotate the squeegee roller 23 in the counterclockwise direction of the drawing, that is, in a direction the same as that of the printing drum 1.

Cam mechanisms B are provided at the side plates 3 in the circular disk shape attached to the both ends of the printing drum 1. The cam mechanism B is constituted by a cam portion 61 in a crescent shape formed along a portion of the inner peripheral face of the printing drum 1 and a cam follower roller 59 which is brought into sliding contact and engaged with the cam portion 61. The cam follower roller 59 is concentric with the squeegee roller 23 and is provided at an end portion of the squeegee roller 23 via the gear 58.

An outer roller 63 is provided on the outer side of the printing drum 1. The outer roller 63 is formed by a non-elastic material of metal or the like and is constituted in an outer shape substantially the same as the printing drum 1. The outer roller 63 is provided in parallel with the printing drum 1 with a predetermined interval between the peripheral wall 7 and the outer roller 63 by a central shaft 62. Further, the outer roller 63 is provided with a recess portion 65 for avoiding interference with the clamp plate 11 for clamping a stencil sheet, the clamp base plate 5 and the like in the printing drum 1.

The outer roller 63 is provided with a sheet clamp member 67. The sheet clamp member 67 is pivotably mounted to the outer roller 63 by an axial shaft 69. One end of the sheet clamp member 67 is provided with a clamp piece 71 for engageably and disengageably clamping a print sheet P in cooperation with an outer peripheral face of the outer roller 63.

The outer roller 63 is provided with a cam mechanism C for clamping or releasing a print sheet P. The cam mechanism C is constituted by a cam 75 substantially in a shape of half moon fixedly arranged to the outer roller 63 concentrically therewith and a cam follower 73 provided at the other end of the clamp piece 71 supported by the axial shaft 69. The outer periphery of the cam 75 substantially in the shape of half moon is formed with a cam portion 74 formed by a left flat portion 70, a right flat portion 72 and a small diameter portion 76 and a large diameter portion 78 in FIG. 1 and FIG. 2. The cam portion 74 forms a stepped portion by the left flat portion 70 and the small diameter portion 76. And the right flat portion 72 is extended in a tangential line direction of the small diameter portion 76. The cam follower roller 73 is brought into sliding contact with the outer peripheral face of the cam 75 substantially in the shape of half moon and engaged with the cam portion 74.

Figure 2:
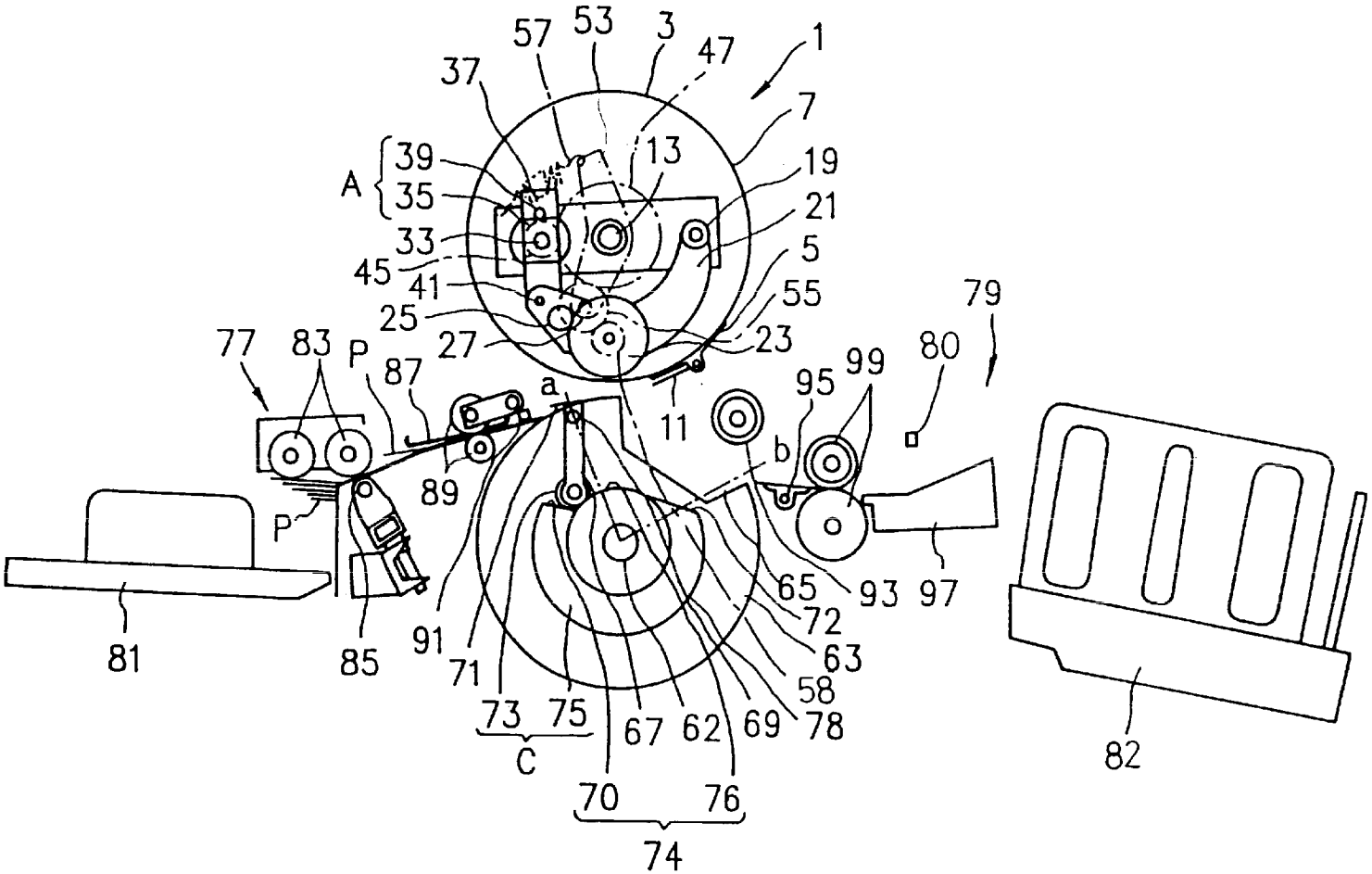
FIG. 2 is a schematic side view showing the example of the structure of the stencil printing machine to which the present invention is applicable and is a view showing a nonprinting state.
Figure 3:
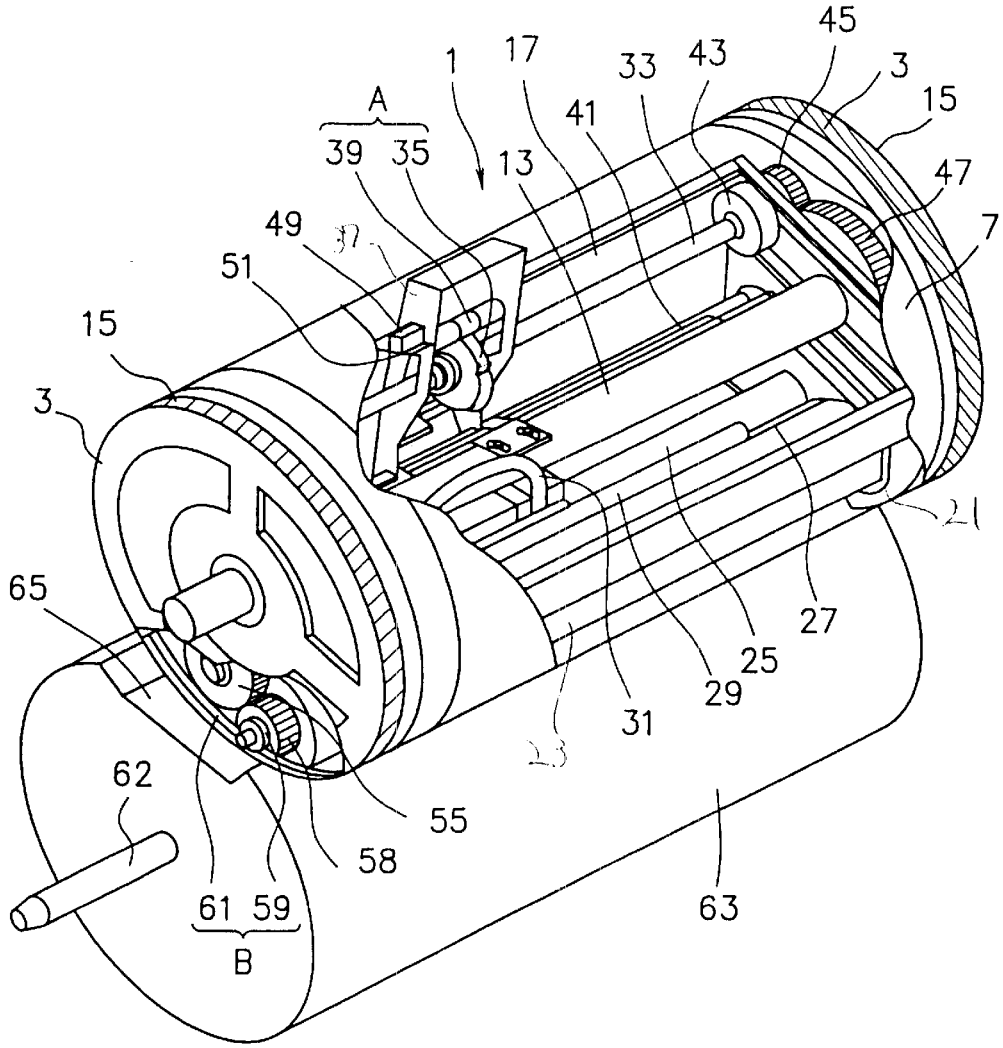
FIG. 3 is a perspective view showing an example of the structure of the stencil printing machine to which the present invention is applicable and is a view showing the nonprinting state.
Figure 4:
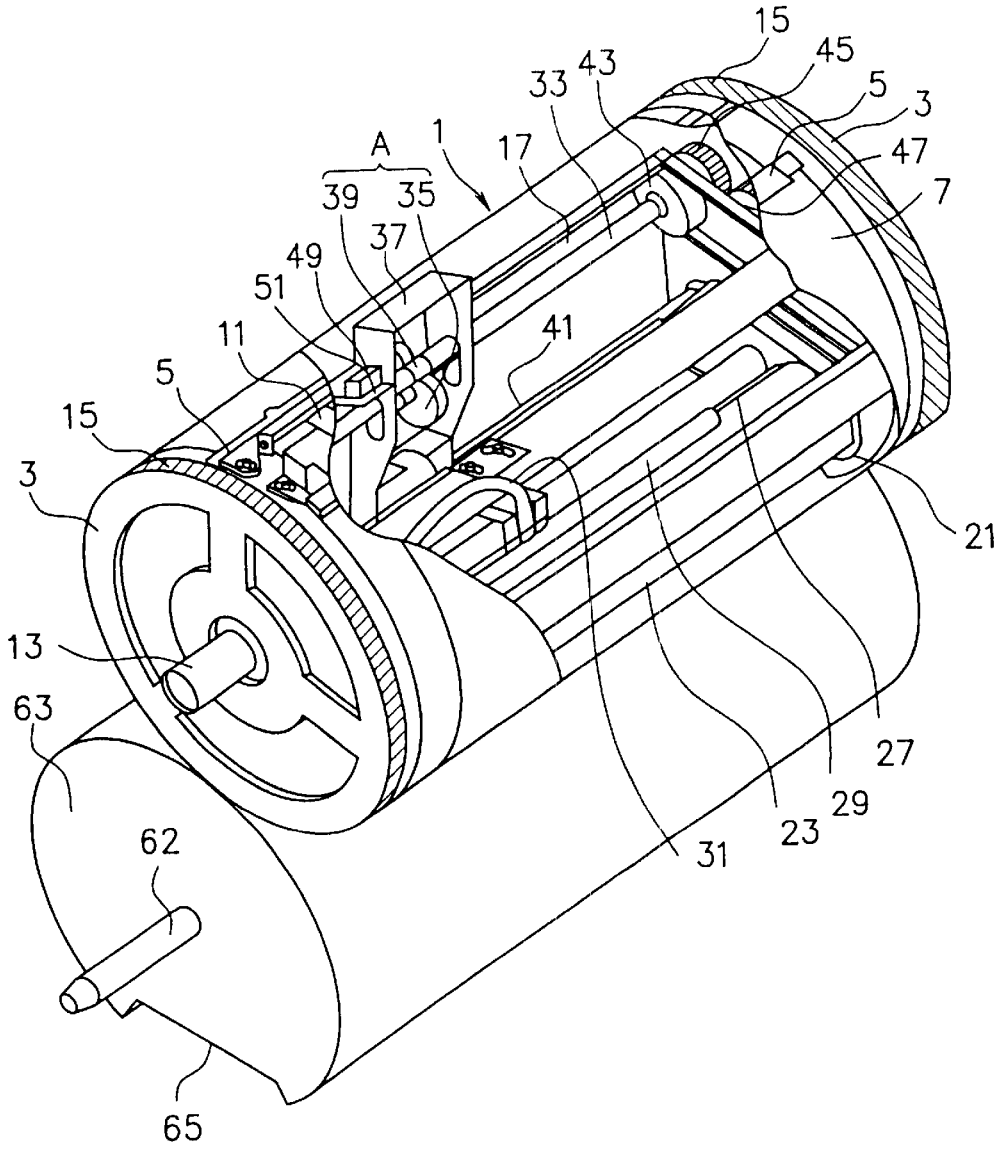
FIG. 4 is a perspective view showing the example of the structure of the stencil printing machine to which the present invention is applicable and is a perspective view showing the printing state.

In FIG. 1 and FIG. 2, there is provided a paper feed section 77 on the left side of the printing drum 1. The paper feed section 77 includes a paper feed base 81 for loading print sheets P, paper feed rollers 83 and a paper handle roller 85 for picking a print sheet P sheet by sheet from the paper feed base 81, paper guide members 87, a pair of timing rollers 89 for transferring a print sheet P to a paper bite position by the clamp piece 71 of the outer roller 63 at predetermined timings and a paper feed sensor 91 of an optical type for detecting that a print sheet P is transferred to the paper bit position. Further, the paper bite position refers to a position of clamping the front end of a print sheet P fed from the paper feed section 77 on the left side of FIG. 2 in synchronism with rotation of the outer roller 63 and refers to a rotational position "a" indicated by notation "a" in FIG. 2.

In FIG. 1 and FIG. 2, there is provided a paper discharge section 79 on the right side of the printing drum 1. The paper discharge section 79 includes a paper discharge pinch roller 93 arranged at a position of releasing sheet for discharging and transferring a print sheet P in cooperation with the outer roller 63, a paper separating claw 95 for separating a print sheet P from the outer roller 63, a pair of discharge pinch rollers 99 for transferring a print sheet P from the paper separating claw 95 to a sheet flying base 97, a paper discharge base 82 for loading printed print sheets P and a paper discharge sensor 80 of an optical type for detecting that a print sheet P is flown from the flying base 97 to the paper discharge base 82. Further, a sheet release position refers to a position of releasing clamp of print sheet P and a position "b" at which the clamp piece 71 is rotationally moved to a side of the paper discharge section 79 on the right side of FIG. 2 by rotation of the outer roller 63.

Further, the paper discharge pinch roller 93 and the upper side roller of the pair of paper discharge pinch rollers 99 which are brought into sliding contact with an upper face of discharged print sheet P, that is, a print image face thereof, are respectively brought into sliding contact with margin portions (nonprinted margin portions) on both sides of a print sheet P. Positions of the upper side rollers in the axis line directions are automatically adjusted in accordance with the size of a print sheet P set on the paper feed base 81 such that the upper side rollers are brought into sliding contact with only the both sides margin portions of a print sheet P regardless of the dimension of a print sheet P in the width direction. In this case, although not illustrated in the drawings, the paper feed base 81 is provided with a sheet size sensor for detecting the size of a print sheet P.

An explanation will be given of operation of the stencil printing machine having the above-described constitution.

First, a perforated stencil sheet is mounted to be wound around the outer peripheral face of the printing drum 1. After finishing to set the stencil sheet, a number of print sheets is inputted by ten keys of an operation panel, not illustrated, thereafter, a start key is depressed. Then, by bringing the printing drum driving gear portion 15 of the printing drum 1 and the drive gear of the printing drum drive motor in mesh with each other, the printing drum 1 is driven to rotate in the counterclockwise direction of the drawing with the central cylindrical shaft 13 as a fixed support shaft member.

At a rotational phase at which the recess portion 65 of the outer roller 63 is opposed to the printing drum 1, the cam follower 59 is engaged with the cam portion 61 formed on the inner peripheral face of the printing drum 1 by rotation of the printing drum 1. By engaging with the cam portion 61, the cam follower 59 lifts the squeegee roller 23 at a rotational phase in correspondence with a sheet clamp area of the printing drum, that is, moves the squeegee roller 23 inwardly in the diameter direction and separates the squeegee roller 23 from the inner peripheral face of the peripheral wall 7. Thereby, collision of the clamp base 5 and a corner portion of the recess portion 65 of the outer roller 63 is avoided. Emittance of impact sound is prevented and the peripheral wall 7 is protected.

Further, when the start key of the operation panel is depressed, similar to the printing drum 1, also the outer roller 63 is driven to rotate in synchronism therewith in the clockwise direction of the drawing at a speed same as that of the printing drum 1 around the central axis line of its own by a synchronizing rotation drive apparatus, not illustrated.

With start of rotation of the printing drum 1 and the outer roller 63, a print sheet P is picked up sheet by sheet from the paper feed base 81 by the paper feed roller 83 and the paper handle roller 85. The picked-up print sheet P is moved to the pair of timing rollers 89 while being guided by the sheet guide members 87.

When the printing drum 1 and the outer roller 63 are rotated to predetermined rotational phase positions, the pair of timing rollers 89 transfer the print sheet P to the sheet bite position "a" by the clamp piece 71 of the outer roller 63 at a predetermined timing.

Next, when the cam switch 49 is not brought into ON state, electricity is conducted over a predetermined time period to the electromagnetic clutch 43. Thereby, the cam is rotated by 90 degree and is disposed at the print execution rotational position. At this moment, by engaging the cam switch 49 with the switch operation piece 51, it is detected that the outer shape plate cam 35 is disposed at the printing execution rotational position.

The squeegee roller 23 is lowered and is brought into contact with the inner peripheral face of the peripheral wall 7 of the printing drum 1. In accordance with rotation of the printing drum 1, the squeegee roller 23 presses the peripheral wall 7 outwardly in the diameter direction and deforms the peripheral wall 7 toward the outer roller 63.

At this moment, ink of the ink store portion 27 is measured in passing through the very small gap between the squeegee roller 23 and the doctor rod 25 by rotation of the squeegee roller 23 in the counterclockwise direction of the drawing. The ink is adhered to the outer peripheral face of the squeegee roller 23 by a predetermined thickness in a shape of a layer. Thereafter, the ink is conveyed to the inner peripheral face of the peripheral wall 7 by rotation of the squeegee roller 23. Further, the ink is squeegeed to the inner peripheral face of the peripheral wall 7.

Further, when the print sheet P is fed from the paper feed section 77 on the left side in FIG. 2 in synchronism with rotation of the outer roller 63, by engagement at the cam mechanism C, the front end of the print sheet P is clamped at the paper bite position "a". Further, the print sheet P is wound around the outer peripheral face of the outer roller 63 by rotation of the outer roller 63 and is moved to the contact portion with the printing drum 1, in this case, a bulged and deformed portion of the peripheral wall 7. Thereby, the print sheet P is sandwiched by predetermined press force between the bulged and deformed peripheral wall 7 and the outer roller 63 along with the stencil sheet wound and mounted around the outer peripheral face of the printing drum 1. The print sheet P is subjected to stencil printing while being transferred in the right direction in accordance with the rotation of the printing drum 1 and the outer roller 63.

Further, when the printing drum 1 and the outer roller 63 are rotated until the front end of the clamp of the print sheet P reaches the sheet release position "b", clamp of the print sheet P by the clamp piece 71 is released. Further, transfer of the print sheet P is succeeded by the paper discharge pinch roller. Thereafter, the print sheet P is separated from the outer roller 63 by the paper separating claw 95. Further, the print sheet P is transferred to the sheet flying base 97 by the pair of paper discharge pinch rollers 99. The transferred print sheet P is flown from the sheet flying base 97 to the paper discharge base 82 and is loaded on the paper discharge base 82 with the print image face directed upwardly.

Further, the outer roller 63 according to the embodiment is operated as a paper drum having a print sheet transfer mechanism for winding a print sheet P around the outer peripheral face of the roller to thereby forcibly transfer between the sheet bite position "a" and the sheet release position "b".

Figure 5:
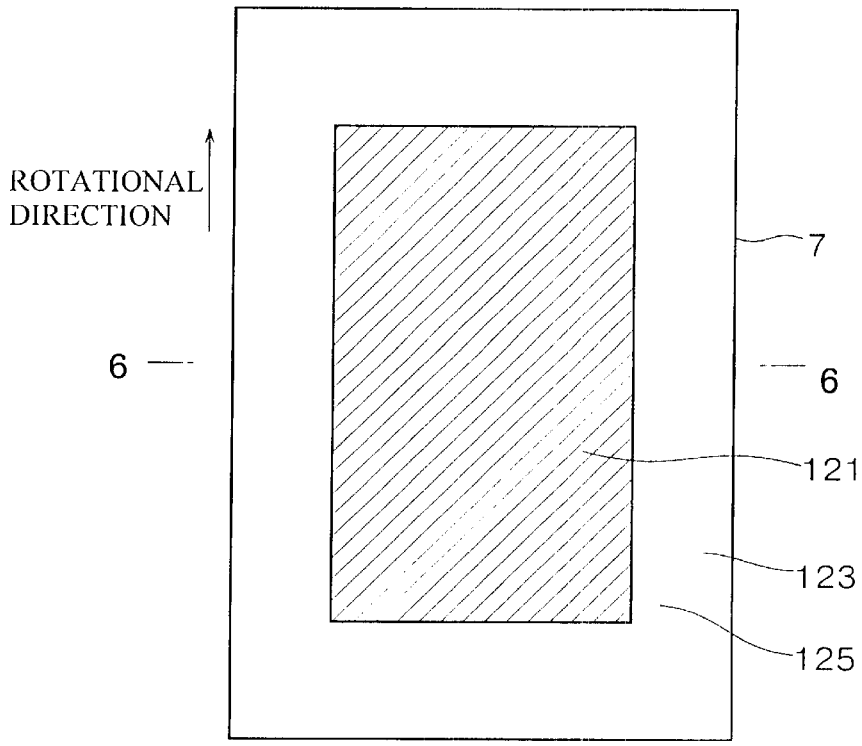
FIG. 5 is a plan view of a developed peripheral wall according to an example of an embodiment of the present invention.

An explanation will be given of an embodiment of the peripheral wall 7 constituting the essential portion of the present invention. FIG. 5 is a view developing the peripheral wall 7 and shows the inner peripheral face of the peripheral wall 7. Further, in FIG. 5, a direction shown by an arrow mark designates the rotational direction of the printing drum 1 in the printing operation.

According to the peripheral wall 7, as described above, flexible wire members comprising stainless steel wires are woven in a shape of a net. The peripheral wall 7 forms the ink-permeable perforated portion 121 and the ink-nonpermeable nonperforated portion 123. Ink can permeate through the perforated portion 121 by meshes comprising the flexible wire members. The nonperforated portion 123 is constituted by coating a material which is not invaded by ink such as silicone or the like by a method of printing or the like to close the meshes comprising the flexible wire members. That is, as shown by FIG. 5, the nonperforated portion 123 is formed by closing the meshes of the peripheral wall 7 to leave the perforated portion 121 in a rectangular shape substantially at the central portion of the peripheral wall 7.

Figure 6:
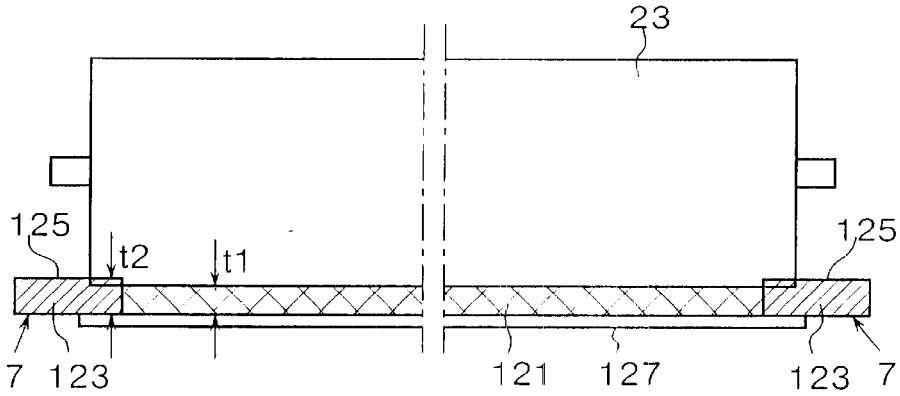
FIG. 6 is an enlarged sectional view taken along ling 6—6 in FIG. 5 showing an inner roller which is brought in touch with the peripheral wall.

On the inner peripheral face of the peripheral wall 7 constituted in this way, above the nonperforated portion 123, as shown by FIG. 6, a projected portion 125 is formed such that a thickness (t2) of the nonperforated portion 123 is thicker than a thickness (t1) of the perforated portion 121. The projected portion 125 is provided on the nonperforated portion 123 of the inner peripheral face of the peripheral wall 7 to surround an entire peripheral edge portion of the perforated portion 121.

The projected portion 125 which is a portion formed thicker than the perforated portion 121 can be formed by coating a material same as the material constituting the nonperforating portion 123 by a method of printing or the like. In this case, the projected portion 125 is formed after forming the nonperforated portion 123 or the projected portion 125 is formed simultaneously with forming the nonperforated portion 123.

Further, the projected portion 125 can be also formed by pasting an ink-nonpermeable flexible sheet other than the constitution constituting the nonperforated portion 123. In this case, the projected portion 125 is formed after forming the nonperforated portion 123. The flexible sheet may be constituted by a material which is not invaded by ink. For example, resin, rubber, metal or the like can be utilized.

The squeegee roller (inner roller) 23 at inside of the printing drum 1 is constituted by an elastic material of rubber or the like. Therefore, when the printing drum 1 is constituted by winding the peripheral wall 7 on the outer peripheral faces of the two side plates 3, as shown by FIG. 6, the squeegee roller 23 is brought into contact with the perforated portion 121 and the both ends of the squeegee roller 23 are brought into contact also with the nonperforated portion 123.

An explanation will be given of operation of the peripheral wall 7 having the above-described constitution.

Figure 7:
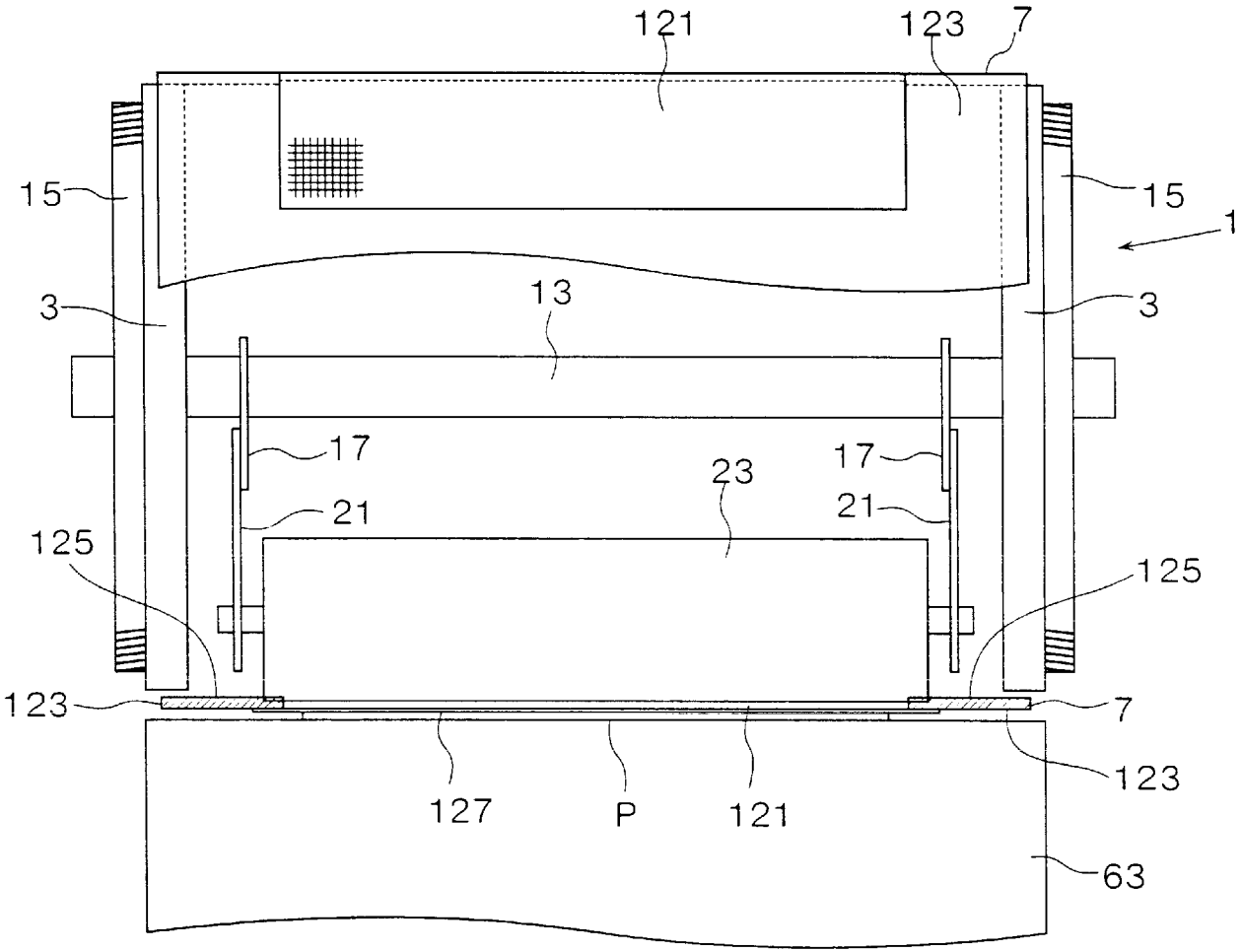
FIG. 7 is a partially broken front view of a printing drum and an outer roller according to an example of an embodiment of the present invention and is a view showing the printing state.

As shown by FIG. 7, the perforated stencil sheet 127 is wound around the outer peripheral face of the peripheral wall 7 constituting the printing drum 1. The perforated stencil sheet 127 is of a size covering all of the perforated portion 121 and brought into contact with the nonperforated portion 123 in the outer peripheral face of the peripheral wall 7. When the printing drum 1 is rotated, the squeegee roller 23 is lifted and lowered in synchronism therewith. A print sheet P is fed to between the printing drum 1 and the outer roller 63 at a predetermined timing. The print sheet P is transferred while being sandwiched between the peripheral wall 7 deformed outwardly by being pressed by the squeegee roller 23 and the outer roller 63. During the time period, ink is transcribed onto the print sheet P by permeating from the perforated portion 121 and a perforated portion of the stencil sheet 127 to thereby carry out stencil printing.

In the printing operation, there is produced press force in sandwiching the print sheet P between the squeegee roller 23 and the outer roller 63 to the stencil sheet 127 wound around the peripheral wall 7 and the peripheral wall 7. Further, the squeegee roller 23 is brought into contact with the perforated portion 121 and the nonperforated portion 123 at the inner peripheral face of the peripheral wall 7. Therefore, the press force is exerted to the perforated portion 121 and the nonperforated portion 123 with which the squeegee roller 23 is brought into contact. The nonperforated portion 123 of the inner peripheral face of the peripheral wall 7 is formed with the projected portion 125. Therefore, the press force exerted to the stencil sheet 127 and the peripheral wall 7 becomes larger on the nonperforated portion 123 having a larger thickness than on the perforated portion 121. Further, ink which has permeated from the perforated portion 121 of the peripheral wall 7 to the stencil sheet 127, is not moved to the side of the nonperforated portion 123 having larger pressure and stays to the side of the perforated portion 121 having smaller pressure. Therefore, ink is not leaked out from the gap between the outer peripheral face of the nonperforated portion 123 and the stencil sheet 127.

In this way, by forming the projected portion 125 constituting the portion which is formed thicker than the perforated portion 121 at the nonperforated portion 123 of the inner peripheral face of the peripheral wall 7, the press force produced at the stencil sheet 127 and the peripheral wall 7 in the printing operation becomes larger on the nonperforated portion 123 than on the perforated portion 121. Therefore, ink can be prevented from leaking out from the gap between the outer peripheral face of the nonperforated portion 123 and the stencil sheet 127.

Meanwhile, although in FIG. 6, there is shown an example in which the projected portion 125 is provided at the entire the nonperforated portion 123 such that the nonperforated portion 123 is formed thicker than the perforated portion 121, the following examples are also conceivable.

Figure 8:
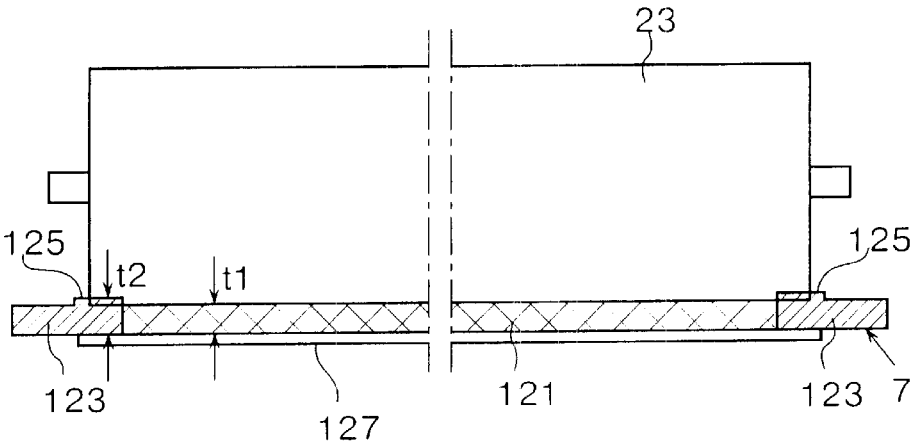
FIG. 8 is a partial sectional view in another example of an embodiment of the present invention showing the inner roller and the stencil sheet which are brought into contact with the peripheral wall.

An example shown in FIG. 8 is an example in which the projected portion 125 is provided at a portion of the nonperforated portion 123 with which the squeegee roller 23 is brought into contact, that is, along a peripheral edge portion of the perforated portion 121 at the inner peripheral face of the peripheral wall 7. Also in this constitution, the above-described effect can be achieved.

Figure 9:
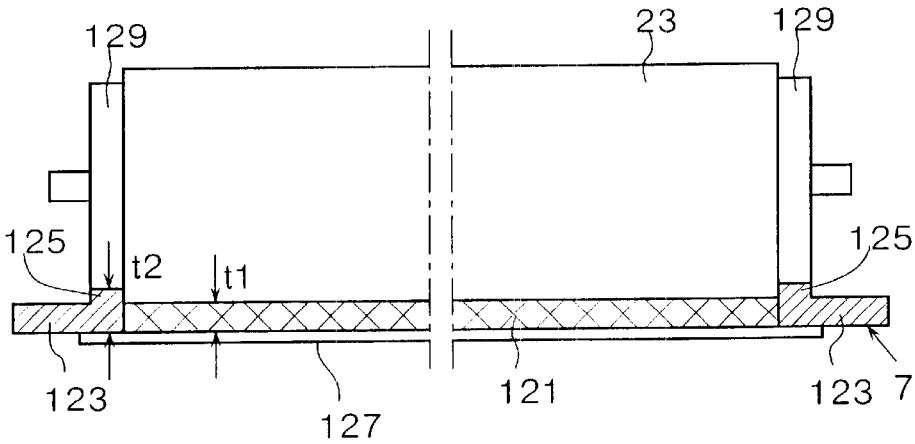
FIG. 9 is a partial sectional view of another example of an embodiment of the invention showing the inner roller and the stencil sheet which are brought into contact with the peripheral wall.

An example shown by FIG. 9 is an example in which in the squeegee roller 23, there are formed recess portions 129 in mesh with the projected portions 125 and constituting recesses smaller than the height of the projected portions 125 at a surrounding of the squeegee roller 23 which is brought into contact with the projected portions 125 disposed on the both side edge portions of the perforated portion 121 in the rotational direction (arrow mark direction indicated in FIG. 5) of the peripheral wall 7 in the printing operation. According to the constitution, ink can be prevented from leaking out from side portions of the stencil sheet 127 which is brought into contact with the outer peripheral face of the nonperforated portion 123 by making press force exerted to the nonperforated portion 123 larger than press force exerted to the perforated portion 121. Further, by making uniform press force exerted to the perforated portion 121, print image having high quality can be provided.

Further, according to the example shown in FIG. 9, in arranging the projected portion 125, the projected portion 125 is formed along the peripheral edge portion of the perforated portion 121 in correspondence with the example of FIG. 8. The invention is not limited thereto but the projected portion 125 may be formed at the entire the nonperforated portion 123 in correspondence with the example of FIG. 6.

Figure 10:
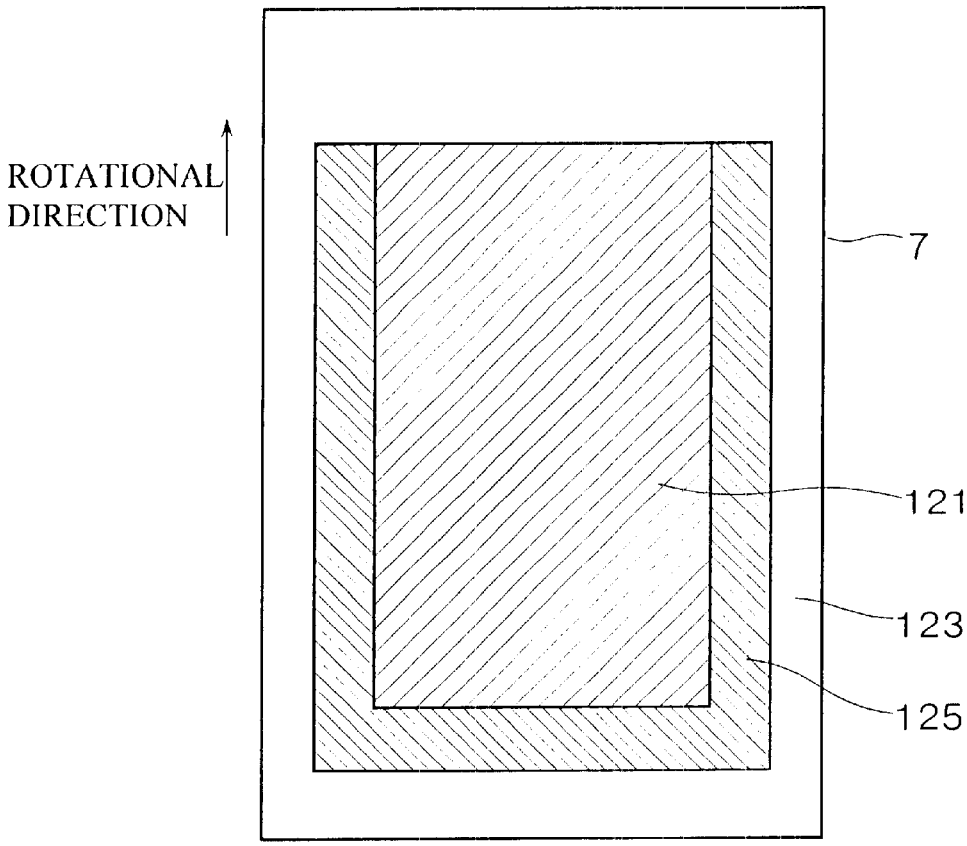
FIG. 10 is a plan view of a developed peripheral wall according to another example of an embodiment of the present invention.
Figure 11:
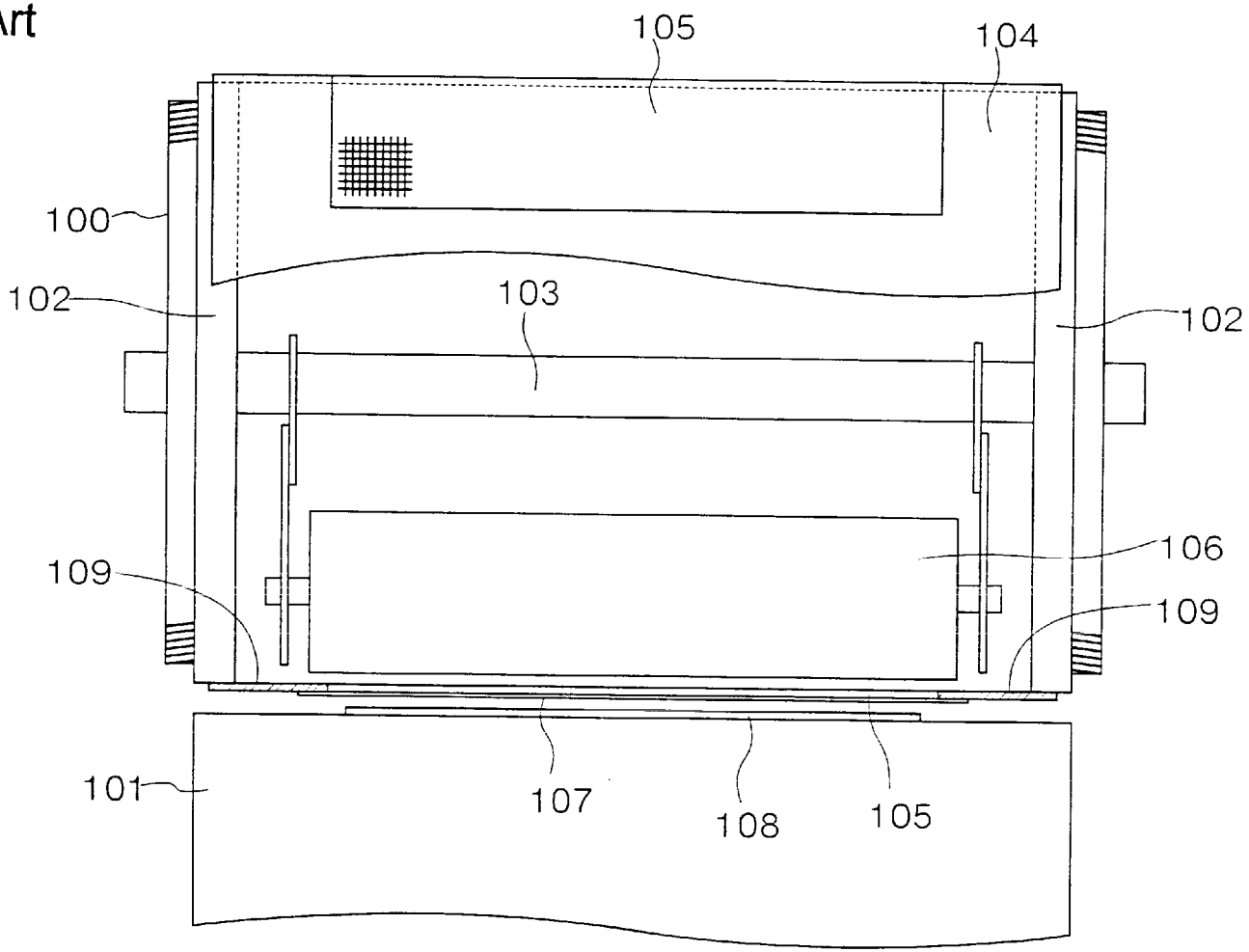
FIG. 11 Prior Art
FIG. 11 is a front view of a printing drum and a partially-notched outer roller in a conventional stencil printing machine and is a view showing a nonprinting state.
Figure 12:
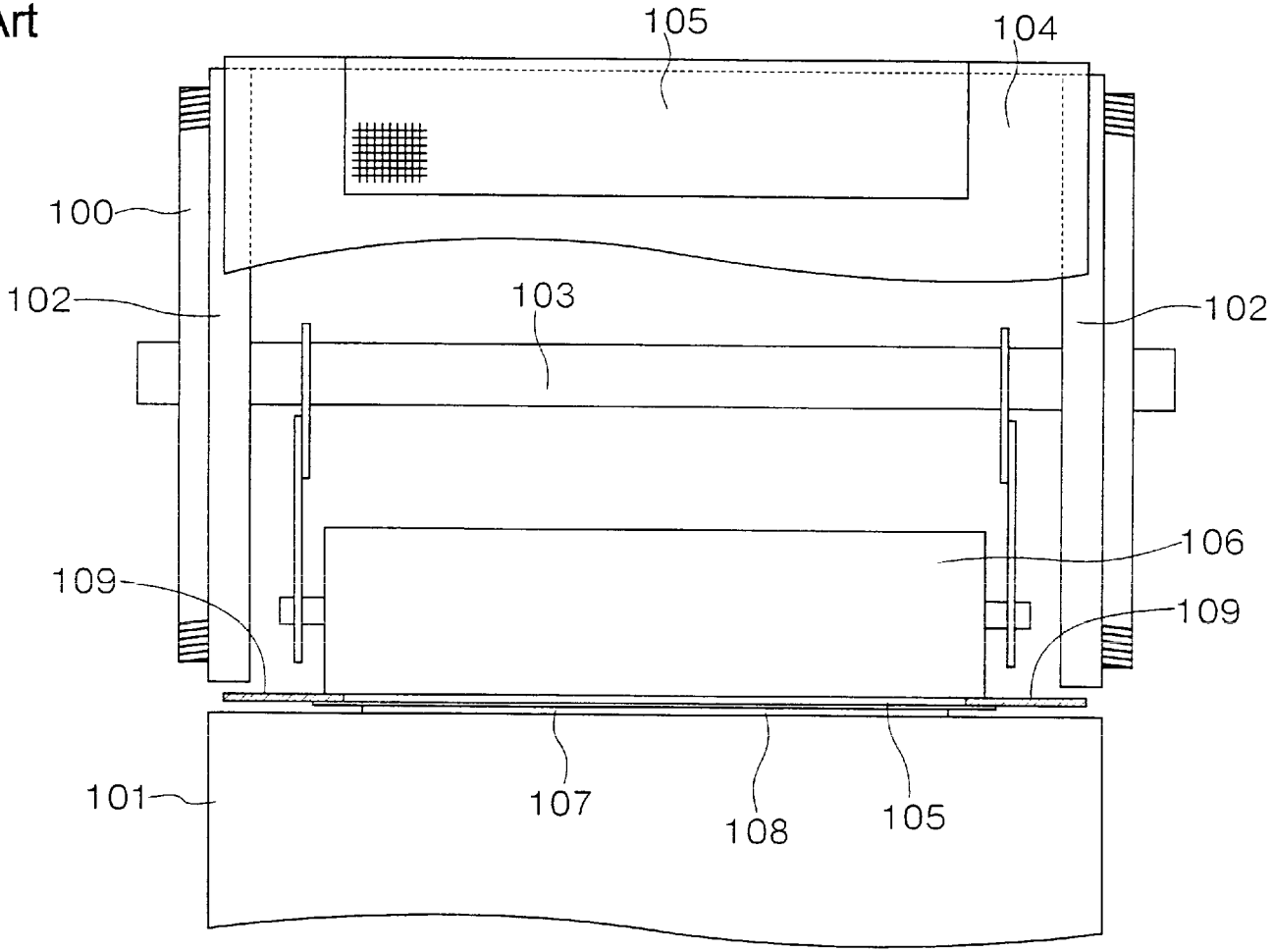
FIG. 12 Prior Art
FIG. 12 is a front view of the printing drum and the partially notched outer roller in the conventional stencil printing machine.
Figure 13:
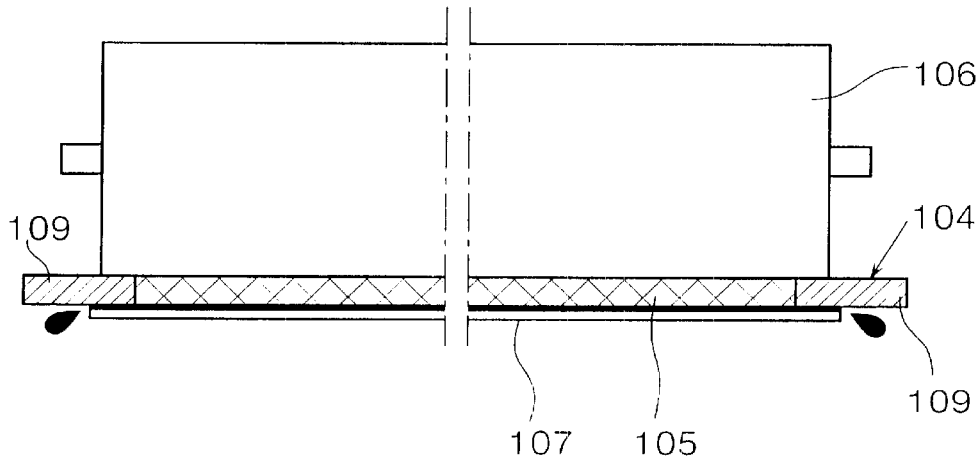
FIG. 13 Prior Art
FIG. 13 is a partial sectional view showing an inner roller and a stencil sheet which are brought into contact with a peripheral wall of the conventional stencil printing machine and is a view showing a state in which ink leaks.

Further, the projected portions 125 having the respective constitutions shown in FIG. 6, FIG. 8 and FIG. 9 are provided on the nonperforated portion 123 of the inner peripheral face of the peripheral wall 7 to surround the entire peripheral edge portion of the perforated portion 121. As shown by FIG. 10, the projected portion 125 may be formed along side edge portions and a rear side edge portion of the perforated portion 121 in the rotational direction (arrow mark direction in the drawing) of the peripheral wall 7 in the printing operation.

In the printing operation, the squeegee roller 23 is brought into contact with the inner peripheral face of the peripheral wall 7 from a front edge portion side of the perforated portion 121 in the rotational direction of the peripheral wall 7 (arrow mark direction of drawing). Therefore, the squeegee roller 23 distributes to level ink in a direction reverse to the rotational direction of the peripheral wall 7. Therefore, almost no ink is leaked out from the gap between the outer peripheral face of the nonperforated portion 123 and the stencil sheet 127 at the front edge portion of the perforated portion 121. Therefore, even with the arrangement of the projected portion 125 in FIG. 10, sufficient effect is achieved.

Further, FIG. 10 is a plan view showing an example in correspondence with the example shown by FIG. 8 or FIG. 9 (example of providing the projected portion 125 along the peripheral edge portion of the perforated portion 121) and the invention can naturally deal with the example shown in FIG. 6.

Further, leakage of ink from the gap between the outer peripheral face of the nonperforated portion 123 and the stencil sheet 127 is significant at the both side edge portions of the perforated portion 121 in the rotational direction of the peripheral wall 7 (arrow mark direction in FIG. 10). Therefore, although not illustrated, the projected portion 125 may be formed only along the both side edge portions of the perforated portion 121 in the rotational direction (arrow mark direction in FIG. 10) of the peripheral wall 7 in the printing operation.

Further, in the peripheral wall 7 according to the above-described embodiment, the projected portion 125 is formed on the inner peripheral side of the nonperforated portion 123. And the thickness (t2) of the nonperforated portion 123 is made thicker than the thickness (t1) of the perforated portion 121 to thereby enhance the press force exerted in the printing operation on the side of the nonperforated portion 123. By forming the perforated portion 121 such that the thickness is thin by forming (for example, press forming) thereof whereby the inner peripheral face of the perforated portion 121 is made lower than the inner peripheral face of the nonperforated portion 123, the press force exerted in the printing operation may be enhanced on the side of the nonperforated portion 123.

According to the present invention, in the stencil printing machine incorporating the inner roller in the printing drum having the peripheral wall having the ink-nonpermeable nonperforated portion around the ink-permeable perforated portion for winding a stencil sheet and carrying out the printing operation while transferring the print sheet by sandwiching the print sheet between the printing drum and the outer roller, the thickness on the inner peripheral side of the nonperforated portion is formed to be thicker than the thickness of the perforated portion. Therefore, the press force exerted to the peripheral wall and the stencil sheet becomes larger on the side of the nonperforated portion by sandwiching the inner roller and the outer roller. Therefore, spread of ink can be stopped within the range of the perforated portion. And ink can be prevented from leaking out from the gap between the outer peripheral face of the nonperforated portion and the stencil sheet.

Further, the portion formed to be thicker than the perforated portion is formed as the projected portion provided on the nonperforated portion constituting the inner peripheral side of the peripheral wall. The projected portion is formed along the both side edge portions of the perforated portion or the both side edge portions and the rear side edge portion of the perforated portion in the rotational direction of the printing drum. Thereby, the above-described effect can be achieved pertinently.

Further, in the inner roller, there are formed the recess portions constituting the recesses in mesh with the projected portions and smaller than the height of the recess portion at the portions in contact with the projected portions formed along the both side edge portions of the perforated portion. Thereby, the above-described effect can pertinently be achieved and print image having high quality can be provided by making uniform the press force exerted to the perforated portion.

What is claimed is:

1. A stencil printing machine comprising:

a printing drum in a cylindrical shape having a peripheral wall having an ink-permeable perforated portion and an ink-nonpermeable nonperforated portion around the ink-permeable perforated portion to have a perforated stencil sheet on an outer peripheral face of the peripheral wall, said nonperforated portion having a thickness greater than that of the perforated portion and projecting inwardly from an inner peripheral face of the perforated portion, said printing drum rotating around a central axis line thereof;

ink supplying means provided inside the printing drum for supplying ink onto the inner peripheral face of the peripheral wall;

an inner roller provided inside the printing drum in parallel with the printing drum and having an inner portion contacting the perforated portion and an outer portion contacting the nonperforated portion, said outer portion providing a contact pressure with the nonperforated portion greater than that of the inner portion with the perforated portion when printing; and an outer roller provided outside the printing drum in parallel with the printing drum and brought into contact with the outer peripheral face of the peripheral wall.

2. The stencil printing machine according to claim 1, wherein a portion of the nonperforated portion formed to be thicker than the perforated portion is constituted by a projected portion provided on the nonperforated portion on a side of the inner peripheral face of the peripheral wall; and the projected portion is formed along two side edge portions of the perforated portion in a direction of rotating the printing drum.

3. The stencil printing machine according to claim 2, wherein the inner roller is formed with recess portions brought in mesh with the projected portions and constituting recesses smaller than a height of the projected portions at portions of the inner roller brought into contact with the projected portions formed along the two side edge portions of the perforated portion.

4. The stencil printing machine according to claim 1, wherein a portion of the nonperforated portion formed to be thicker than the perforated portion is constituted by a projected portion provided on the nonperforated portion on a side of the inner peripheral face of the peripheral wall; and the projected portion is formed along two side edge portions and a rear side edge portion of the perforated portion in a direction of rotating the printing drum.

5. The stencil printing machine according to claim 1, wherein the nonperforated portion is constituted by coating an ink-nonpermeable material around the perforated portion constituted by weaving flexible wire members in a shape of a net to constitute the perforated portion.

6. The stencil printing machine according to claim 1, wherein said nonperforated portion formed thicker than the perforated portion includes a portion formed of an ink-nonpermeable flexible sheet different from a material forming the nonperforated portion.

7. The stencil printing machine according to claim 1, wherein said inner roller having the inner and outer portions has a same outer diameter throughout an entire length thereof so that the outer portion contacting the nonperforated portion is compressed stronger than the inner portion contacting the perforated portion to thereby prevent ink from flowing to the nonperforated portion when the inner roller contacts the peripheral wall.

8. The stencil printing machine according to claim 7, wherein said inner roller is formed of an elastic material to provide resiliency.

* * * * *